United States Patent [19]

Fauth

[11] 4,324,265

[45] Apr. 13, 1982

[54] CAN END WASHER AND DRYER

[75] Inventor: Frederick E. Fauth, Towson, Md.

[73] Assignee: American Bottlers Equipment Company, Inc., Owings Mills, Md.

[21] Appl. No.: 123,728

[22] Filed: Feb. 22, 1980

[51] Int. Cl.[3] ..... B08B 3/04; B08B 5/04; B05B 1/28

[52] U.S. Cl. ..... 134/82; 134/21; 134/198; 239/120

[58] Field of Search ..... 134/155, 166 R–169 C, 134/172, 186, 198, 21, 82, 83, 165; 239/104, 106, 112, 120, 548, 558; 15/321, 322

[56] References Cited

U.S. PATENT DOCUMENTS 2,910,077 10/1959 Blake et al. ..... 134/21 X
3,594,849 7/1971 Coshow ..... 134/21 X

*Primary Examiner*—Andrés Kashnikow
*Attorney, Agent, or Firm*—Cantor and Singer

[57] ABSTRACT

A device for cleaning can ends made in the form of a flat circular member having a number of high pressure fluid orifices disposed in a circle on one flat face of the member and connected internally to a high pressure air inlet. Alternating with the orifices are a number of through-bores which serve as exhaust ports.

4 Claims, 5 Drawing Figures

CAN END WASHER AND DRYER

BACKGROUND OF THE INVENTION

This invention relates to food and beverage canning, and more particularly this invention relates to an apparatus and method for washing and drying the tops of food and beverage cans.

Numerous types of food and beverages such as beer or soft drinks are commonly packaged in so-called "tin-cans." The misnomer "tin-can" is a hold-over from the early days of the canning industry when tin-plated steel was used to fabricate the cans. In modern canning, tin-plated steel is still sometimes used, although aluminum or an aluminum alloy, is more commonly used. In some instances, steel coated with a plastic or synthetic elastomer is also used.

After filling and seaming the cans, they are normally processed by pasteurization or sterilization in the beer and food industries, or warming for package protection from humidity damage in the soft-drink industry. But, these processes may cause contamination of the outside surface of the can, such contamination being either bacteriological or, simply, dirt. There, therefore, has been a need for a way to clean the ends of the cans for both sanitary reasons and aesthetic reasons.

Quite often, the cans are processed by washing them to remove surface dirt and contamination, but the wash water remains on the cans, especially in crevices. Thus, any dirt coming in contact with the wet surface, remains, and residual water, on steel-based cans especially, can cause corrosion. Corrosion is also a problem with the so-called "ecological tab end" cans, or cans with opening tabs which, after being opened, fold out of the way instead of breaking off. The pre-cut area of the ecological tab is thinner than the formerly used pull tab pre-cut area, and consequently is more prone to corrosion damage. There still exists, therefore, a need for a method and means to effectively clean the can ends without leaving a residue.

BRIEF SUMMARY OF THE INVENTION

It is, therefore, a primary object of the present invention, to provide a device for quickly and efficiently cleaning can ends.

It is another object of the present invention to provide a device for cleaning can ends which can be used in conjunction with a high-speed conveying apparatus.

It is still another object of the present invention to provide a device for cleaning can ends which is inexpensive to manufacture and can be adapted for use in existing conveyor lines.

It is yet another object of the present invention, consistent with the foregoing objects, to provide a method for cleaning can ends which is simple and efficient.

Consistent with these objects, the present invention provides a device for cleaning can ends comprising a flat, circular member having a plurality of high pressure fluid outlet orifices evenly spaced on one side of said circular member and disposed in an annular array on a circle having a diameter approximately equal to the diameter of the can end, a plurality of exhaust ports extending through said member, evenly spaced apart and disposed in an annular array on said circle, and alternating with said orifices, a high pressure fluid inlet, and a plurality of high pressure fluid conduits connecting said inlet and said orifices. In a preferred embodiment, there are eight orifices spaced apart forty-five degrees and eight exhaust ports spaced apart forty-five degrees and alternating with the orifices. In a further preferred embodiment, it is recognized that most cans, such as beverage cans, for instance, have a raised rim about the outer periphery of the end and, consequently, a depressed annular groove having a diameter slightly smaller than the rim. In order to efficiently clean contamination from the groove, the diameter of the circle on which the orifices and ports are disposed, is approximately equal to the diameter of the groove.

In the method of the present invention, the aforedescribed device is used in one location on a conveyor line to rinse the can ends with water at high pressure and another such device is located further down the conveyor line to direct air at high pressure against the can ends to remove residual water.

BRIEF DESCRIPTION OF THE DRAWINGS

The foregoing objects will be described, and other objects will become apparent, by reference to the following description of the preferred embodiments and the drawings, wherein.

DESCRIPTION OF THE PREFERRED EMBODIMENTS

Figure 1:
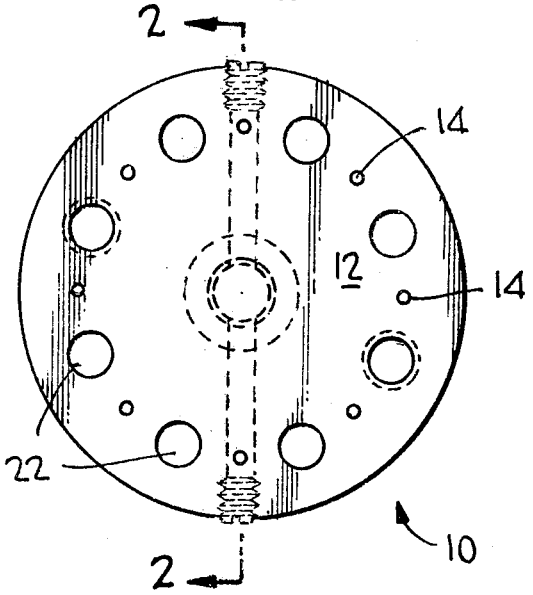
FIG. 1 is a bottom plan view of the device of the present invention.

Referring to FIG. 1, the device of the present invention, generally designated by the numeral 10, is a flat, circular, member 12 having a plurality of orifices 14 equally spaced in an annular array on a circle which is approximately the diameter of the can end being cleaned. In the preferred embodiment, the orifices 14 are on a circle having a diameter approximately equal to the diameter of the circumferential groove which appears on most cans. This diameter is well-known in the canning art, although for reference, some representative diameters of standard can sizes are shown below in Table 1.

TABLE 1

| Can Diameter | Diameter of Orifice Array |
|---|---|
| 209 | 2-5/16 inches |
| 207 | 2-3/16 inches |
| 211 | 2-7/16 inches |
| 205.5 | 2-1/16 inches |
| 303 | 3 inches |

Obviously, the diameter of member 12 is somewhat larger than the diameter of the circle on which the orifices lie. In another embodiment, when the device is used for washing, the diameter of the orifice array could be smaller than the can diameter as, for example, in the neighborhood of $1\frac{7}{8}$ inches.

Figure 2:
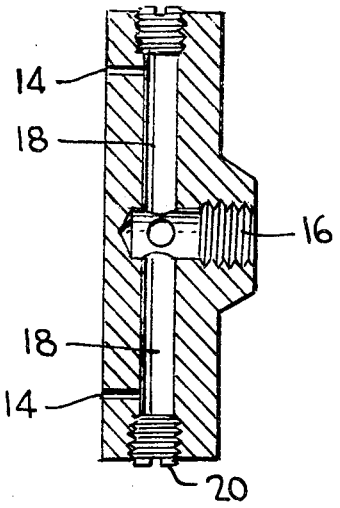
FIG. 2 is a cross-sectional view taken on the line 2—2 of FIG. 1.

Referring now to FIG. 2, there is provided a high pressure fluid inlet 16 which is threaded for a standard pipe fitting. Fluid inlet 16 communicates with conduits 18 which, in turn, communicate with orifices 14. For ease of construction, conduits 18 are bored completely through member 12 and then the ends are threaded and plugged as shown at 20.

In addition, a plurality of exhaust ports 22 are bored completely through member 12. Exhaust ports 22 are also evenly spaced and are disposed on the same circle as orifices 14. While any number of orifices 14 and exhaust ports 22 can be used, for practical purposes it has been found that eight of each operate quite satisfactorily.

The device 10 of the present invention can be used to direct water under high pressure at the can ends and can also be used to direct air under high pressure at the can ends. Thus, in an old installation where can washing means of a different type are already used, the device 10 would be used to dry the can ends by using high pressure air as the fluid. In a new installation, or where a more efficient washing means is desired, a device 10 would be used to wash the cans with water and another device 10 would be used to dry the cans with air.

Figure 3:
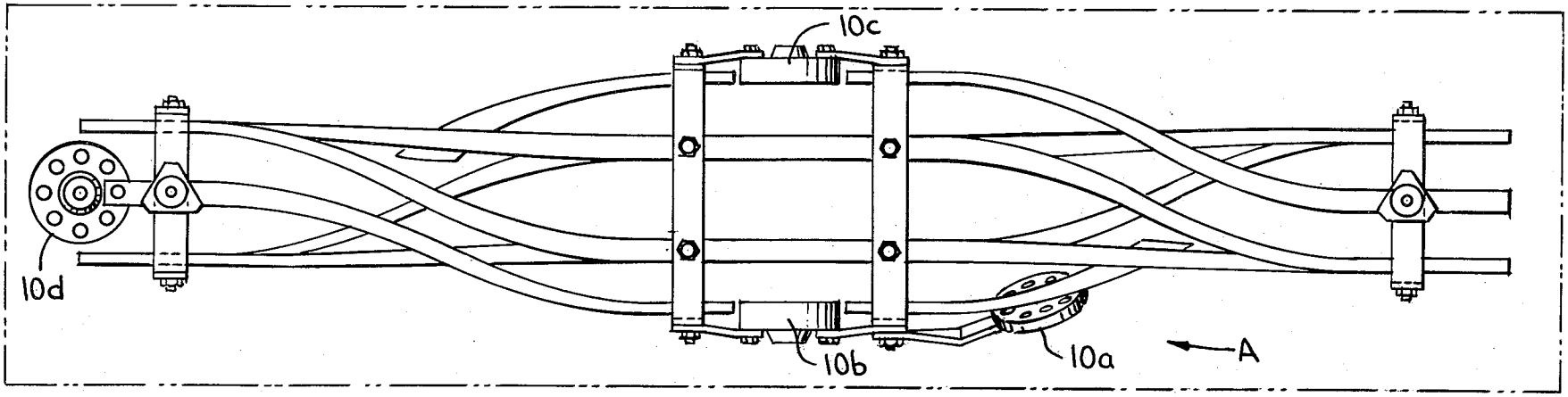
FIG. 3 is a top view of a portion of a conveyor line showing the placement of the device of FIG. 1.
Figure 4:
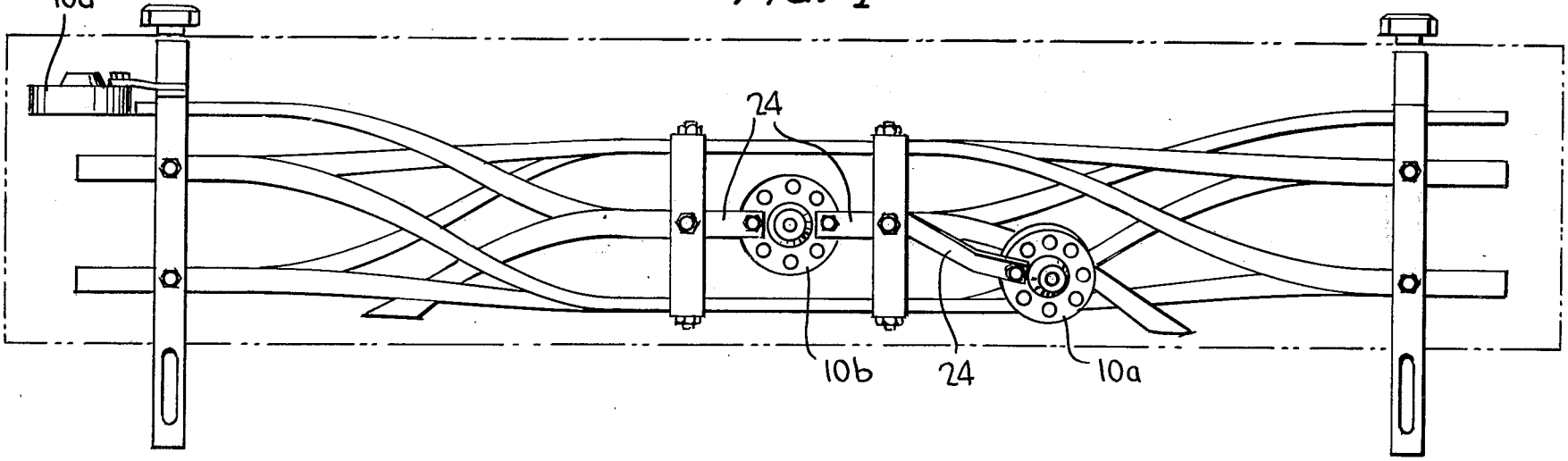
FIG. 4 is a front view of the portion of a conveyor line shown in FIG. 3.

A portion of a typical conveyor line is shown in FIGS. 3 and 4. The cans move along the line in the direction shown by arrow A past a first station where one of the devices, denoted 10*a* is disposed for washing the top end of the can. As the can passes cleaning device 10*a*, the can is lying on its side, with the top end slightly below the bottom end of the can. The end of the can passes extremely close to cleaning device 10*a*, the distance between device 10*a* and the top of the can being approximately 1/16–⅛ inch. Cleaning device 10*a* is connected to a high-pressure water supply (not shown) and directs the water at the can top at an extremely high velocity. Water splashing from the can top, and carrying contamination with it, escapes through exhaust ports 22. The can then proceeds to a second station, the can now being approximately horizontal, where air is directed at a high velocity through orifices 14 in cleaning device 10*b*. When the axis of the can top coincides with the axis of the cleaning device 10*b*, the numerous jets of air from orifices 14 create a turbulence in the characteristic deep circumferential groove of the can top which thereby loosens soil and atomizes the trapped water. The soil and water are ejected through exhaust ports 22. This process can be performed in a fraction of a millisecond due to the high velocity air jets, in the range of 40,000 to 50,000 feet per minute. Thus, this device can be used in high speed packaging lines.

An optional air dryer 10*c* for drying the can bottom is located opposite air dryer 10*b*. Similarly, another optional air dryer 10*d* is located downstream of dryers 10*b* and 10*c* for providing a final blast of air on the can top, which, by the time it reaches dryer 10*d*, is standing upright.

As can be seen in FIGS. 3 and 4, the cleaning devices 10 can be conveniently mounted by threading one or more of exhaust ports 22 and affixing the device to one or more brackets 24 with bolts screwed into the threaded hole.

Figure 5:
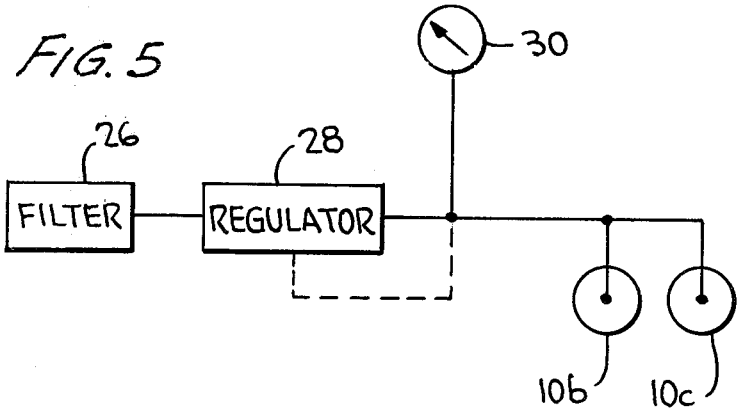
FIG. 5 is a schematic diagram of the air system used for drying cans according to the present invention.

Referring now to FIG. 5, a typical high pressure air installation for use with drying can ends is shown. The air from a standard high pressure source to be found in any bottling plant passes through filter 26 and regulator 28 to the devices 10*b* and 10*c*. A pressure gauge 30 is also present to monitor the pressure. Any suitable source of compressed air could be used which will deliver air at a pressure of from about 30 pounds per square inch gauge to about 70 pounds per square inch gauge, with about 60 pounds per square inch gauge being preferred. At about 60 pounds per square inch, about 9.4 cubic feet of air per minute will pass through each device 10.

Thus, it will be appreciated that the objects set forth at the outset have been accomplished. While this invention has been described by reference to presently preferred embodiments, it is to be distinctly understood that they are presented for illustrative purposes and the invention is limited only by the appended claims.

What is claimed is:

1. A device for cleaning can ends on a high speed conveyor line comprising a flat, circular member adapted to be mounted on said conveyor line such that said can ends are at least momentarily juxtaposed with said circular member and closely spaced thereto, said circular member having a plurality of high pressure fluid outlet orifices evenly spaced on the side of said circular member facing said can ends and disposed in an annular array on a circle having a diameter approximately equal to the diameter of the can end, a plurality of exhaust ports extending through said member and open to the atmosphere on the other side of said circular member, said exhaust ports being evenly spaced apart and disposed in an annular array on said circle and alternating with said orifices, a high pressure fluid inlet, and a plurality of high pressure fluid conduits connecting said inlet and said orifices, whereby the high pressure fluid striking the can ends atomizes at least some of any liquid on said can ends and exhausts same through said ports.

2. A device as claimed in claim 1, comprising eight of said orifices spaced apart 45° and eight of said ports spaced apart 45° and alternating with said orifices.

3. A device as claimed in claim 1 or 2, wherein said inlet is axially disposed in said member and said conduits extend radially between said inlet and said orifices.

4. A device as claimed in claims 1 or 2, wherein said fluid is air.

* * * * *